US010568358B2

(12) United States Patent
Li et al.

(10) Patent No.: US 10,568,358 B2
(45) Date of Patent: Feb. 25, 2020

(54) ATOMIZING HEAD, ATOMIZER AND ELECTRONIC CIGARETTE HAVING SAME

(71) Applicant: Shenzhen First Union Technology Co., Ltd., Shenzhen, Guangdong Province (CN)

(72) Inventors: Yonghai Li, Shenzhen (CN); Zhongli Xu, Shenzhen (CN); Youli Shen, Shenzhen (CN)

(73) Assignee: SHENZHEN FIRST UNION TECHNOLOGY CO., LTD., Shenzhen, Guangdong Province (CN)

( * ) Notice: Subject to any disclaimer, the term of this patent is extended or adjusted under 35 U.S.C. 154(b) by 291 days.

(21) Appl. No.: 15/409,531

(22) Filed: Jan. 18, 2017

(65) Prior Publication Data

US 2017/0127728 A1 May 11, 2017

(30) Foreign Application Priority Data

Feb. 3, 2016 (CN) ..... 2016 1 0073692
Feb. 3, 2016 (CN) ..... 2016 2 0106119 U

(51) Int. Cl.

| | |
|---|---|
| ***A24F 47/00*** | (2006.01) |
| ***B05B 7/16*** | (2006.01) |
| ***B05B 7/22*** | (2006.01) |
| ***B05B 12/10*** | (2006.01) |
| ***H05B 1/02*** | (2006.01) |

(52) U.S. Cl.

CPC ..... *A24F 47/008* (2013.01); *B05B 7/1686* (2013.01); *B05B 7/22* (2013.01); *B05B 12/10* (2013.01); *H05B 1/0244* (2013.01); *H05B 2203/021* (2013.01)

(58) Field of Classification Search

CPC ..... A61M 15/06; A61M 2205/3317; A61M 2205/3368; A61M 2205/3375; A61M 2205/507; A61M 2205/8206; A61M 2205/332; A61M 2016/0024; A61M 16/161; A61M 16/024; A61M 11/042; A61M 11/041; B05B 7/1686; B05B 7/22; B05B 12/10; H05B 1/0244; H05B 2203/021; A24F 47/008

See application file for complete search history.

(56) References Cited

U.S. PATENT DOCUMENTS

2014/0261489 A1* 9/2014 Cadieux ..... A24F 47/008 131/328
2014/0338685 A1* 11/2014 Amir ..... A24F 47/008 131/329
2015/0223520 A1* 8/2015 Phillips ..... A61M 15/06 131/328

* cited by examiner

*Primary Examiner* — Shawntina T Fuqua
(74) *Attorney, Agent, or Firm* — Cheng-Ju Chiang

(57) ABSTRACT

An exemplary atomizing head includes a main body, a liquid inlet, an air inlet, an air outlet, an air passage, a connecting electrode, a liquid conducting element in the main body, a heating element in the main body, and a connecting part. The air passage is in communication with the air inlet and the air outlet. The liquid conducting element is configured for absorbing tobacco liquid flowed in through the liquid inlet. The heating element is in contact with the liquid conducting element, and configured for heating the tobacco liquid absorbed in the liquid conducting element to form aerosol. The aerosol is expelled via the air passage. The connecting part is configured for coupling with an atomizer. The atomizing head further includes a temperature sensing element configured for sensing a temperature of the aerosol.

13 Claims, 4 Drawing Sheets

ATOMIZING HEAD, ATOMIZER AND ELECTRONIC CIGARETTE HAVING SAME

TECHNICAL FIELD

The present invention relates to electronic cigarettes, and particularly to an atomizing head, an atomizer and an electronic cigarette using same.

BACKGROUND ART

A typical electronic cigarette includes an atomizer and a power supply. The atomizer includes a heating element for heating tobacco liquid to form aerosol. However, in use, the aerosol may be too hot for users, and may include a burnt smell when a heating temperature of the heating element is too high.

What are needed, therefore, are an atomizing head, an atomizer and an electronic cigarette using same, which can overcome the above shortcomings.

SUMMARY

An exemplary atomizing head includes a main body, a liquid inlet, an air inlet, an air outlet, an air passage, a connecting electrode, a liquid conducting element in the main body, a heating element in the main body, and a connecting part. The air passage is in communication with the air inlet and the air outlet. The liquid conducting element is configured for absorbing tobacco liquid flowed in through the liquid inlet. The heating element is in contact with the liquid conducting element, and configured for heating the tobacco liquid absorbed in the liquid conducting element to form aerosol. The aerosol is expelled via the air passage. The connecting part is configured for coupling with an atomizer. The atomizing head further includes a temperature sensing element configured for sensing a temperature of the aerosol.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
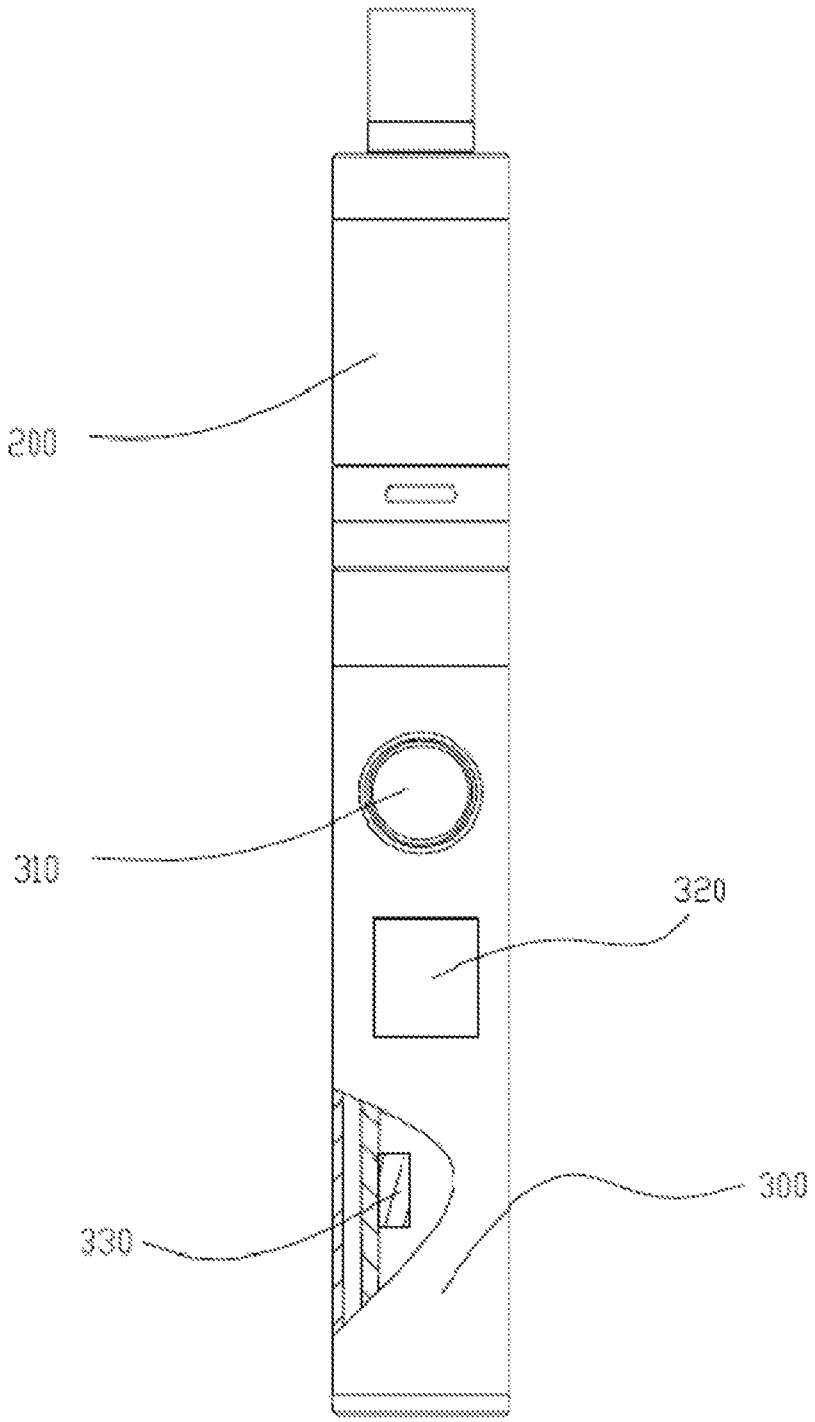
FIG. 1 is a side view of an electronic cigarette according to an embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Several definitions that apply throughout this disclosure will now be presented.

The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

Referring to FIG. 1, an electronic cigarette is shown. The electronic cigarette includes an atomizer 200 and a power supply 300. The atomizer 200 and the power supply 300 are detachably connected, e.g., via screw threads. The power supply 300 is configured (i.e., structured and arranged) for feeding the atomizer 200 power.

Figure 2:
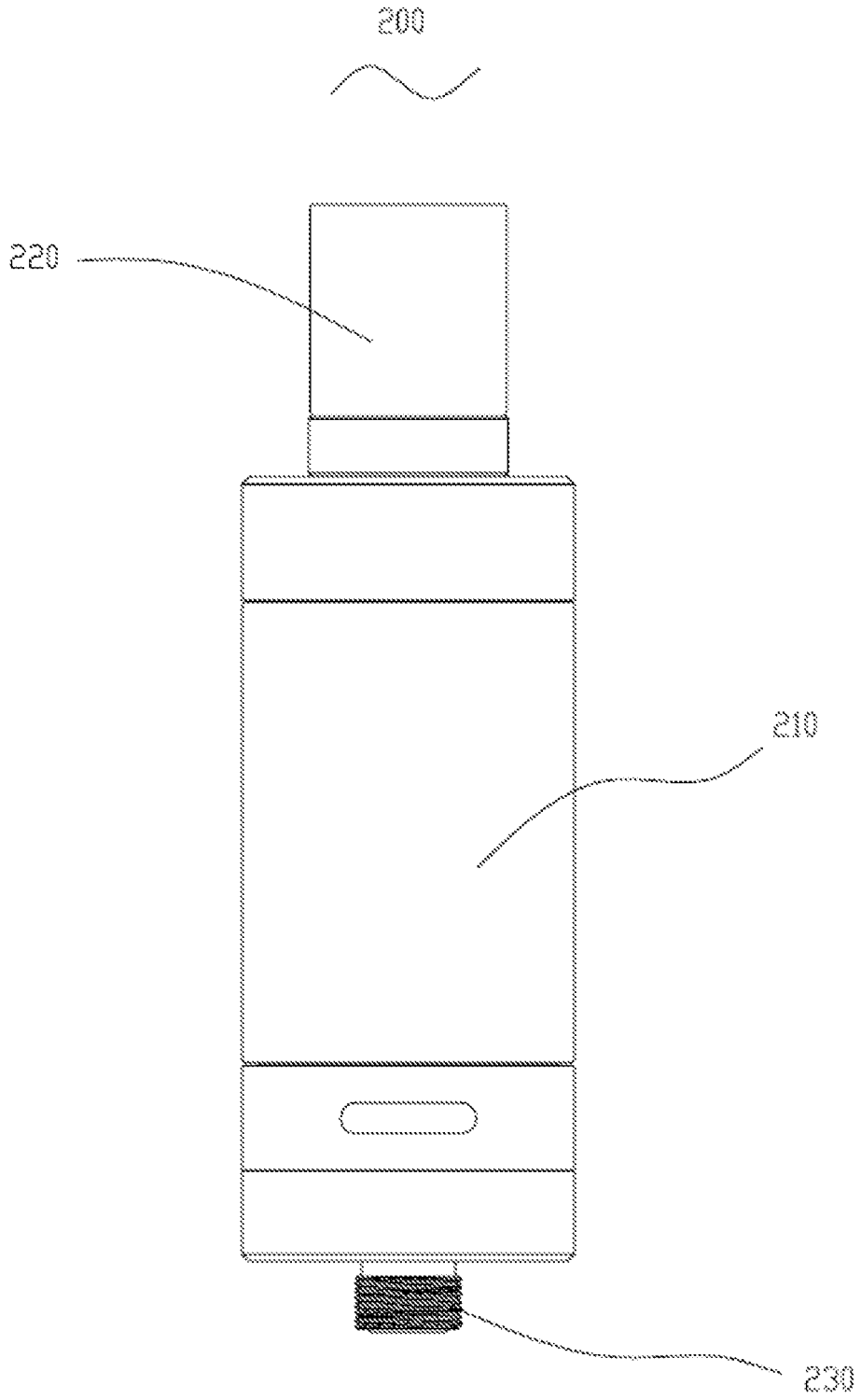
FIG. 2 is a side view of an atomizer of electronic cigarette of FIG. 1.
Figure 3:
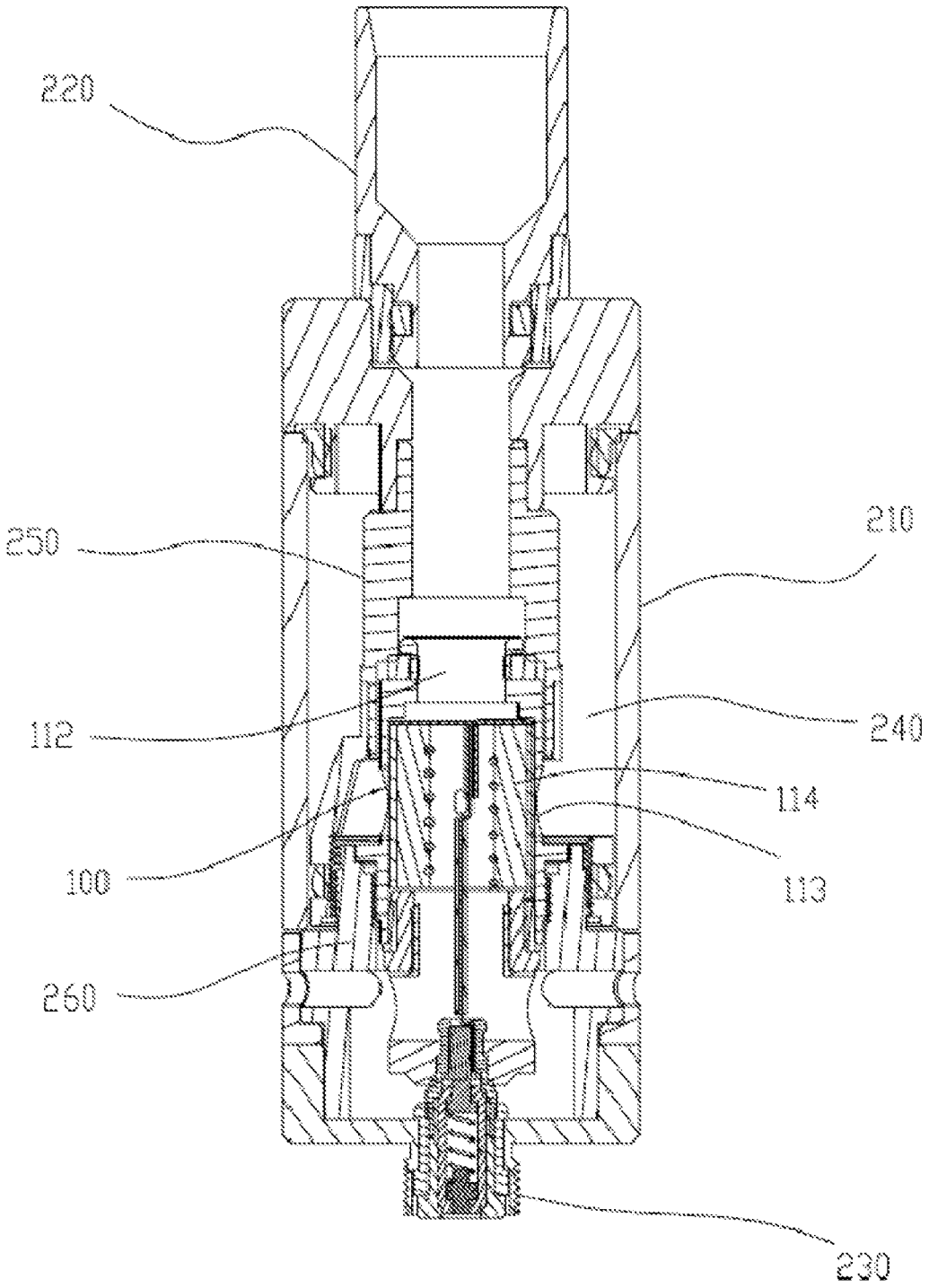
FIG. 3 is a cross-sectional view of the atomizer of FIG. 2.

Referring to FIGS. 2-3, the atomizer 200 includes a housing 210, a mouthpiece 220, and a threaded part 230. The mouthpiece 220 and the threaded part 230 are arranged at two opposite ends of the housing 210. The atomizer 200 further includes a liquid chamber 240 for storing tobacco liquid, an air pipe 250, an atomizing head 100, and a fixing holder 260 for connecting the atomizing head 100.

Figure 4:
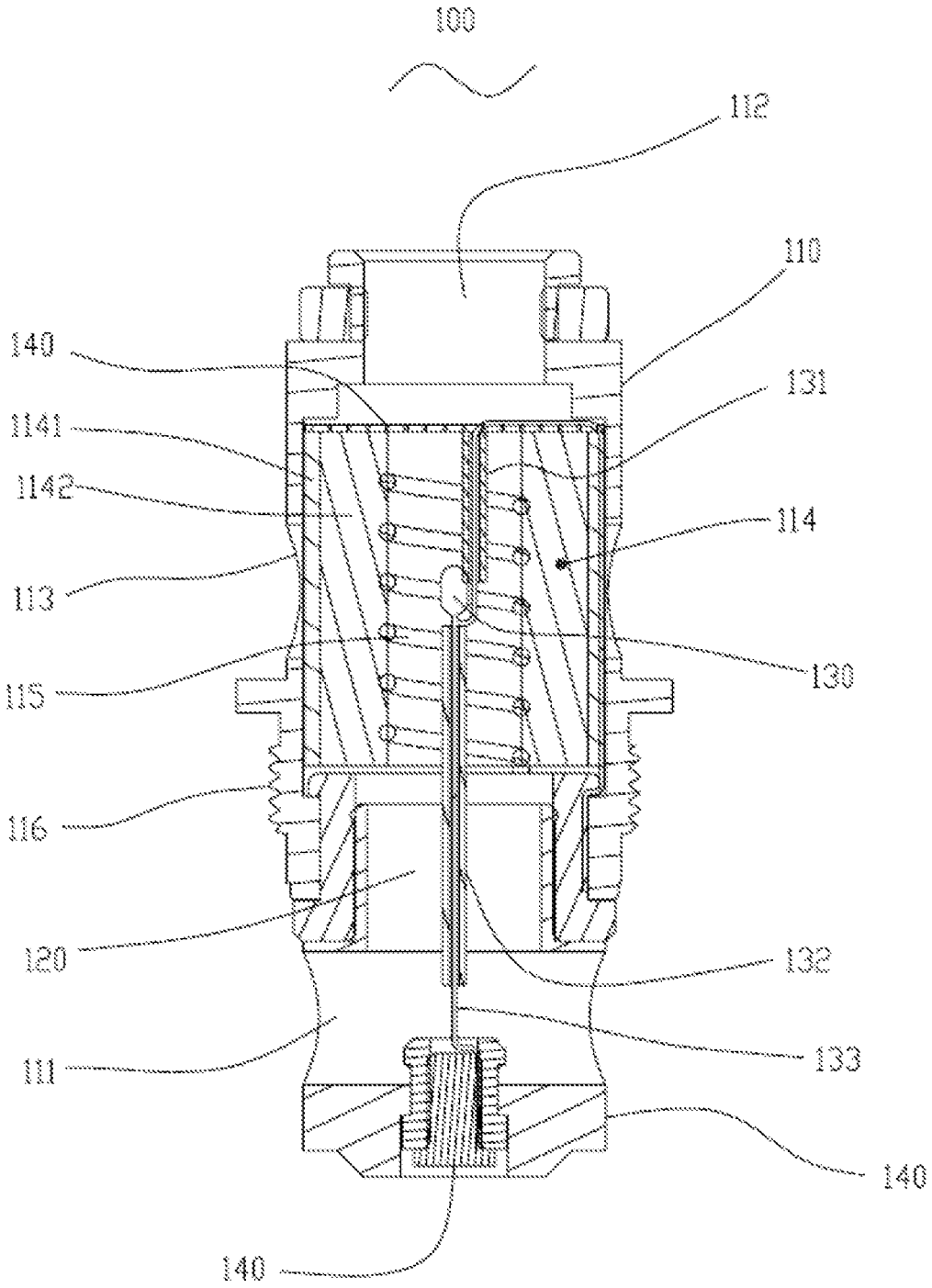
FIG. 4 is a cross-sectional view of an atomizing head of the atomizer of FIG. 3.

Referring to FIG. 4, the atomizing head 100 is detachably connected with the atomizer 200. The atomizing head 100 includes a main body 110, an air inlet 111, an air outlet 112, a liquid inlet 113, an air passage 120, and a connecting electrode 140. The air passage 120 communicates the air inlet 111 and the air outlet 112. The connecting electrode 140 is configured for connecting with a power supply or a processor. The atomizing head 100 further includes a liquid conducting element 114 and a heating element 115. The liquid conducting element 114 is configured for absorbing tobacco liquid, which flows in via the liquid inlet 113. The heating element 115 is in contact with the liquid conducting element 114, and configured for heating the tobacco liquid adsorbed in the liquid conducting element 114 to form aerosol. The aerosol is expelled via the air passage 120. The main body 110 includes a connecting part 116 for connecting to the atomizer 200. The tobacco liquid in the liquid chamber 240 flows to the liquid conducting element 114 via the liquid inlet 113. The air pipe 250 is in communication with the air outlet 112. The main body 110 is detachably connected to the fixing holder 260 via the connecting part 116.

The atomizing head 100 further includes a temperature sensing element 130 in the air passage 120. The temperature sensing element 130 is connected to the connecting electrode 140 via wires 133. The temperature sensing element 130 is configured for sensing a temperature of the aerosol, and sending the temperature data to the processor 330 via the connecting electrode 140. Based on the temperature data, the processor 330 can adjust output power of the heating element 115, so that the temperature of the aerosol is kept in a predetermined temperature. The predetermined temperature may be set by a user of the electronic cigarette, or set by a manufacturer before the electronic cigarette goes on sale.

In the present embodiment, the connecting part 116 includes a threaded structure. The liquid conducting element 114 includes a liquid guiding part 1142, and a liquid storing part 1141 in tight contact with the liquid guiding part 1142. The liquid storing part 1141 is adapted for absorbing and stores tobacco liquid flowed inside through the liquid inlet 113. The liquid guiding part 1142 is configured for absorbing tobacco liquid in the liquid storing part 1141, and supplying the heating element 115 the tobacco liquid for atomization. The temperature sensing element 130 may be a thermistor.

A gauze 140 is further provided in the main body 110. The gauze 140 allows aerosol to pass through, and is positioned in the air passage 120. The gauze 140 is configured for supporting the temperature sensing element 130, and preventing the wires 133 from contacting with the heating element 115. In the present embodiment, the gauze 140 is arranged at an end of the liquid conducting element 114, and adjacent to the air outlet 112. The gauze 140 is made of heat-resisting material, which is capable of withstanding a heating temperature of the heating element 115.

The heating element 115 is arranged in an internal wall of the liquid conducting element 114, and oriented along an axial direction of the main body 110. In the present embodiment, the heating element 115 is a spiral heating wire. The temperature sensing element 130 is arranged in a middle part of the heating element 115, or a top part of the heating element 115. In this way, the temperature sensing element 130 can detect the temperature of the aerosol accurately. Sleeving tubes 131, 132 are provided nesting at least part of two wires 133 adjacent to the heating element 115. The sleeving tubes 131, 132 are made of heat-resisting insulated material, e.g., Teflon, and prevent short circuit between the wires 133 and the heating element 115.

Referring to FIG. 1 again, a temperature adjusting button 310 and a display 320 are provided on the power supply 300. The user of the electronic cigarette can set a temperature of the aerosol via the button 310, and the processor 330 controls an output power of the heating element 115. In the present embodiment, the display 320 is configured for displaying smoking data of the electronic cigarette, a temperature of the aerosol, and etc.

In the present embodiment, quite usefully, the liquid conducting part 1142 is made of ceramic material; the liquid storing part 1141 is made of cotton.

The beneficial results of the present disclosure are as follows. The electronic cigarette includes a temperature sensing element in the air passage, so that a temperature of the aerosol can be kept in the predetermined temperature. Therefore, it is prevented that the user sucks too hot aerosol, and aerosol with a burnt smell.

It is understood that the above-described embodiments are intended to illustrate rather than limit the disclosure. Variations may be made to the embodiments and methods without departing from the spirit of the disclosure. Accordingly, it is appropriate that the appended claims be construed broadly and in a manner consistent with the scope of the disclosure.

What is claimed is:

1. An atomizing head, comprising:

a main body;

a liquid inlet;

an air inlet;

an air outlet;

an air passage in communication with the air inlet and the air outlet;

a connecting electrode;

a liquid conducting element in the main body, the liquid conducting element being configured for absorbing tobacco liquid flowed in through the liquid inlet;

a heating element in the main body, the heating element being in contact with the liquid conducting element, and configured for heating the tobacco liquid absorbed in the liquid conducting element to form aerosol, the aerosol being expelled via the air passage; and a connecting part configured for coupling with an atomizer;

wherein the atomizing head further comprises a temperature sensing element disposed next to and spaced away from the heating element in the air passage and configured for sensing a temperature of the aerosol in the air passage.

2. The atomizing head according to claim 1, further comprising a gauze in the main body, wherein the gauze is in the air passage, configured for supporting the temperature sensing element, and allows the aerosol to pass through.

3. The atomizing head according to claim 1, further comprising wires and sleeving tubes, wherein the wires connect the temperature sensing element to the connecting electrode, parts of the wires adjacent to the heating element are sleeved by the sleeving tubes.

4. The atomizing head according to claim 1, wherein the heating element is oriented in a direction parallel to an axial direction of the main body.

5. The atomizing head according to claim 4, wherein the heating element comprises a spiral heating wire formed on an internal wall of the liquid conducting element.

6. The atomizing head according to claim 1, wherein the temperature sensing element is arranged in a middle part of the heating element, or a top part of the heating element adjacent to the air outlet.

7. The atomizing head according to claim 1, wherein the liquid conducting element is made of ceramic, and the heating element is arranged in the liquid conducting element.

8. The atomizing head according to claim 1, wherein the liquid conducting element comprises a liquid guiding part, and a liquid storing part in tight contact with the liquid guiding part; the liquid storing part is adapted for absorbing and stores tobacco liquid flowed inside through the liquid inlet; the liquid guiding part is configured for absorbing tobacco liquid in the liquid storing part, and supplying the heating element the tobacco liquid for atomization.

9. An atomizer for an electronic cigarette, comprising:

a housing;

a liquid chamber in the housing, the liquid chamber being configured for storing tobacco liquid;

an air pipe in the housing;

an atomizing head according to claim 1, the atomizing head being received in the housing;

a fixing holder in the housing configured for coupling with the atomizing head;

wherein the tobacco liquid in the liquid chamber flows to the liquid conducting element via the liquid inlet, the air pipe communicates with the air outlet, and the main body is detachably engaged with the fixing holder via the connecting part.

10. An electronic cigarette, comprising:

an atomizer according to claim 9; and a power supply configured for supplying the atomizer power.

11. The electronic cigarette according to claim 10, wherein the power supply further comprises a temperature adjusting button, and the button is configured for setting a temperature of the aerosol.

12. The electronic cigarette according to claim 10, wherein the power supply further comprises a display configured for displaying smoking data.

13. The atomizing head according to claim 2, wherein the gauze is arranged at an end of the liquid conducting element, and adjacent to the air outlet.

* * * * *